US008307472B1

(12) United States Patent
Saxon et al.

(10) Patent No.: US 8,307,472 B1
(45) Date of Patent: Nov. 13, 2012

(54) LIGHT EMITTING DIODE SYSTEM

(76) Inventors: Thomas Jason Saxon, Madeira Beach, FL (US); Holly Holleman Saxon, Madeira Beach, FL (US)

( * ) Notice: Subject to any disclaimer, the term of this patent is extended or adjusted under 35 U.S.C. 154(b) by 412 days.

(21) Appl. No.: 12/589,921

(22) Filed: Oct. 30, 2009

Related U.S. Application Data

(60) Provisional application No. 61/206,772, filed on Feb. 4, 2009.

(51) Int. Cl.
*A47K 3/022* (2006.01)
*A47K 3/28* (2006.01)

(52) U.S. Cl. ..... 4/597; 239/18; 362/96

(58) Field of Classification Search ..... 4/597, 596, 4/615; 239/18, 71, 289; 362/96, 109
See application file for complete search history.

(56) References Cited

U.S. PATENT DOCUMENTS

| | | | | |
|---|---|---|---|---|
| 4,274,595 | A * | 6/1981 | Yamin | 239/383 |
| 5,873,647 | A * | 2/1999 | Kurtz et al. | 362/96 |
| 6,439,472 | B1 * | 8/2002 | Lin et al. | 239/18 |
| 6,637,676 | B2 * | 10/2003 | Zieger et al. | 239/548 |
| 7,607,789 | B2 * | 10/2009 | Lu et al. | 362/96 |
| 2009/0070927 | A1 * | 3/2009 | Marrs et al. | 4/612 |

* cited by examiner

*Primary Examiner* — Huyen Le

(57) ABSTRACT

A housing has an upper component formed of an upper plate and a periphery. The upper plate has an upper central aperture. The housing has a lower component formed of a lower plate and a periphery. The lower plate has a lower central aperture. An annular printed circuit board is positioned within the housing. A plurality of light emitting diodes are secured to the printed circuit board and extend downwardly therefrom. A plurality of equally spaced small apertures in the lower plate of the lower component each receive one of the light emitting diodes for providing light.

2 Claims, 3 Drawing Sheets

FIG 1
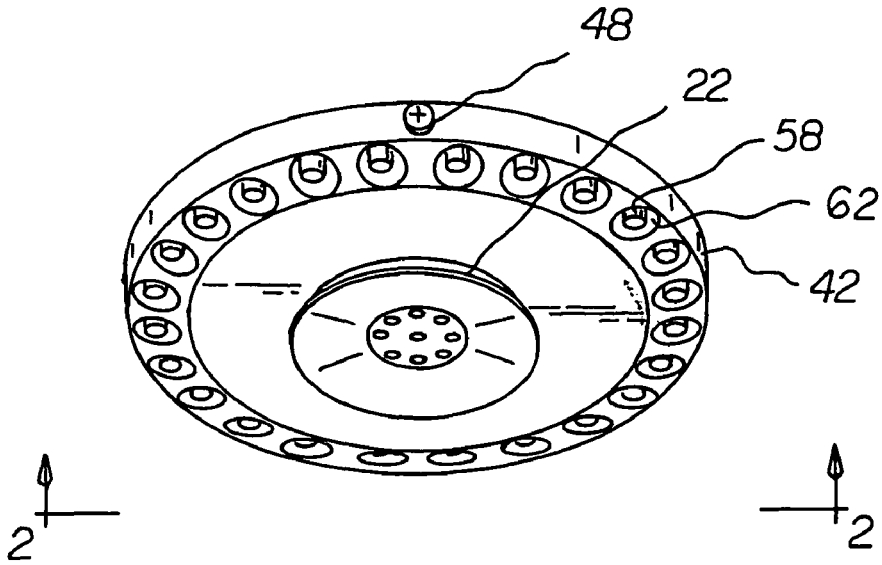
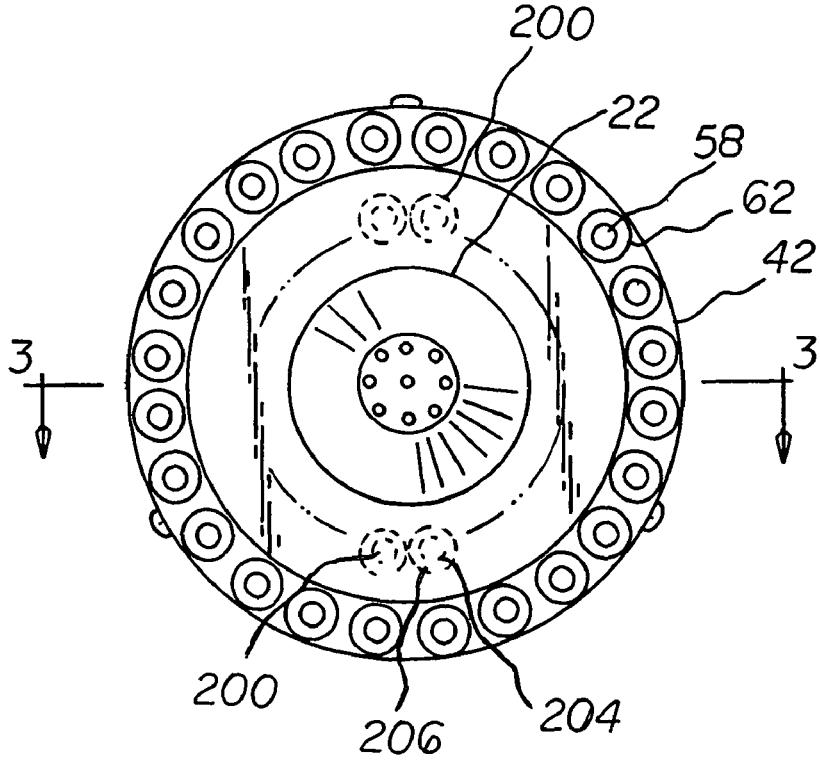
FIG 2

FIG 3
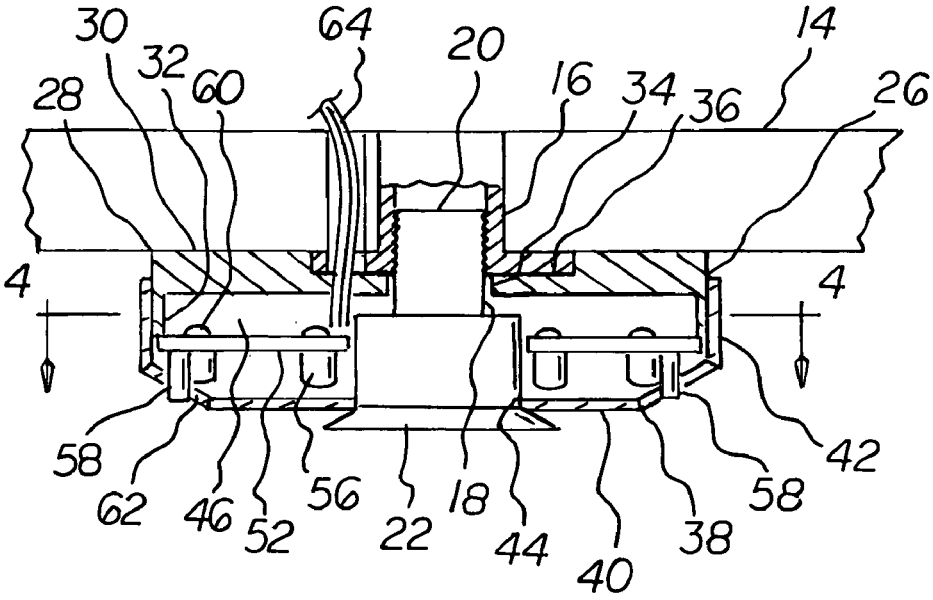
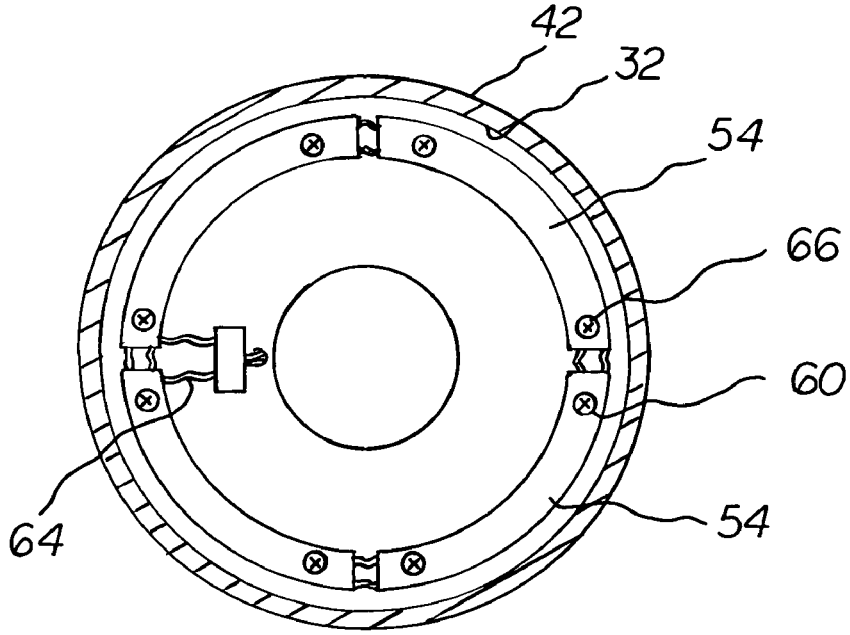
FIG 4

LIGHT EMITTING DIODE SYSTEM

RELATED APPLICATION

This application is based upon and claims the priority of U.S. Provisional Patent Application Ser. No. 61/206,772 filed Feb. 4, 2009 the subject matter of which is incorporated herein by reference.

BACKGROUND OF THE INVENTION

1. Field of the Invention

The present invention relates to a light emitting diode light system and more particularly pertains to illuminating a showering area of a boat or trailer in a safe, convenient and economical manner.

2. Description of the Prior Art

The use of light systems is known in the prior art. More specifically, light systems previously devised and utilized for the purpose of illuminating a showering area are known to consist basically of familiar, expected, and obvious structural configurations, notwithstanding the myriad of designs encompassed by the crowded prior art which has been developed for the fulfillment of countless objectives and requirements.

While prior light systems fulfill their respective, particular objectives and requirements, they do not describe a light emitting diode light system that allows for illuminating a showering area of a boat or trailer in a safe, convenient and economical manner.

In this respect, the light emitting diode light system according to the present invention substantially departs from the conventional concepts and designs of the prior art, and in doing so provides an apparatus primarily developed for the purpose of illuminating a showering area of a boat or trailer in a safe, convenient and economical manner.

Therefore, it can be appreciated that there exists a continuing need for a new and improved light emitting diode light system which can be used for illuminating a showering area of a boat or trailer in a safe, convenient and economical manner. In this regard, the present invention substantially fulfills this need.

SUMMARY OF THE INVENTION

In view of the foregoing disadvantages inherent in the known types of light systems now present in the prior art, the present invention provides an improved light emitting diode light system. As such, the general purpose of the present invention, which will be described subsequently in greater detail, is to provide a new and improved light emitting diode light system and method which has all the advantages of the prior art and none of the disadvantages.

To attain this, the present invention essentially comprises a light emitting diode light system. The light emitting diode light system for boat/trailer showers is for illuminating a showering area in a safe, convenient and economical manner. A light emitting diode may be referred to as an LED.

First provided is a showering area having a ceiling with a hole and a water pipe terminating beneath the hole. A shower head has an upper section coupled to the water pipe. The show head also has a radially enlarged lower section with apertures for dispensing a flow of water into the showering area.

Next provided is a housing having an upper component in an inverted bowl-shaped configuration. The housing is formed of an upper circular plate and a downwardly extending cylindrically shaped periphery. The upper circular plate is in contact with the ceiling. The upper circular plate has an upper central aperture receiving the upper section of the shower head. The upper circular plate also has an annular undercut area adjacent to the upper central aperture facing the ceiling for receiving the water pipe. The housing has a lower component in a bowl-shaped configuration. The lower component is formed of a lower circular plate and an upwardly extending cylindrical shaped periphery receiving the periphery of the upper component. The lower circular plate has a lower central aperture receiving the lower section of the shower head for supporting the housing. A chamber is formed between the upper and lower components. A bolt is threaded through the periphery of the lower component and contacting the periphery of the upper component for selectively coupling the upper and lower components.

An annular printed circuit board is next provided. The printed circuit board is positioned within the housing. The printed circuit board is formed of four 90 degree segments. Each segment has ends with a spacer through each end. The printed circuit board has a central opening receiving the lower component of the housing.

Next provided is a plurality of equally spaced light emitting diodes. The light emitting diodes are secured to the printed circuit board and extend downwardly therefrom. A plurality of equally spaced small apertures are provided in the lower circular plate of the lower component. Each small aperture receives one of the light emitting diodes for providing a circle of light surrounding the shower head. Electrical wires couple the printed circuit board to a source of electrical potential. The upper and lower components are fabricated of stainless steel.

A four position switch is next provided. A first position functions to illuminate the light emitting diodes and feeds showering water through the water pipe and the housing. A second position functions for illuminating the light emitting diodes only. A third position functions for feeding water only and a fourth position for terminating both the illuminating and the feeding of showering water.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved light emitting diode light system which has all of the advantages of the prior art light systems and none of the disadvantages.

It is another object of the present invention to provide a new and improved light emitting diode light system which may be easily and efficiently manufactured and marketed.

It is further object of the present invention to provide a new and improved light emitting diode light system which is of durable and reliable constructions.

An even further object of the present invention is to provide a new and improved light emitting diode light system which is susceptible of a low cost of manufacture with regard to both materials and labor, and which accordingly is then susceptible of low prices of sale to the consuming public, thereby making such light emitting diode light system economically available to the buying public.

Even still another object of the present invention is to provide a light emitting diode light system for lighting up a showering area in a safe, convenient and economical manner.

Lastly, it is an object of the present invention to provide a new and improved light emitting diode light system having a housing with an upper component formed of an upper plate and a periphery. The upper plate has an upper central aperture. The housing has a lower component formed of a lower plate and a periphery. The lower plate has a lower central aperture. An annular printed circuit board is positioned within the housing. A plurality of light emitting diodes are secured to the printed circuit board and extend downwardly therefrom. A plurality of equally spaced small apertures in the lower plate of the lower component each receive one of the light emitting diodes for providing light.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a light emitting diode light system for boat/trailer showers constructed in accordance with the principles of the present invention.

FIG. 2 is a front elevational view of the system taken along line 2-2 of FIG. 1.

FIG. 3 is a cross sectional view taken along line 3-3 of FIG. 2.

FIG. 4 is a cross sectional view taken along line 4-4 of FIG. 3.

The same reference numerals refer to the same parts throughout the various Figures.

DESCRIPTION OF THE PREFERRED EMBODIMENT

Figure 5:
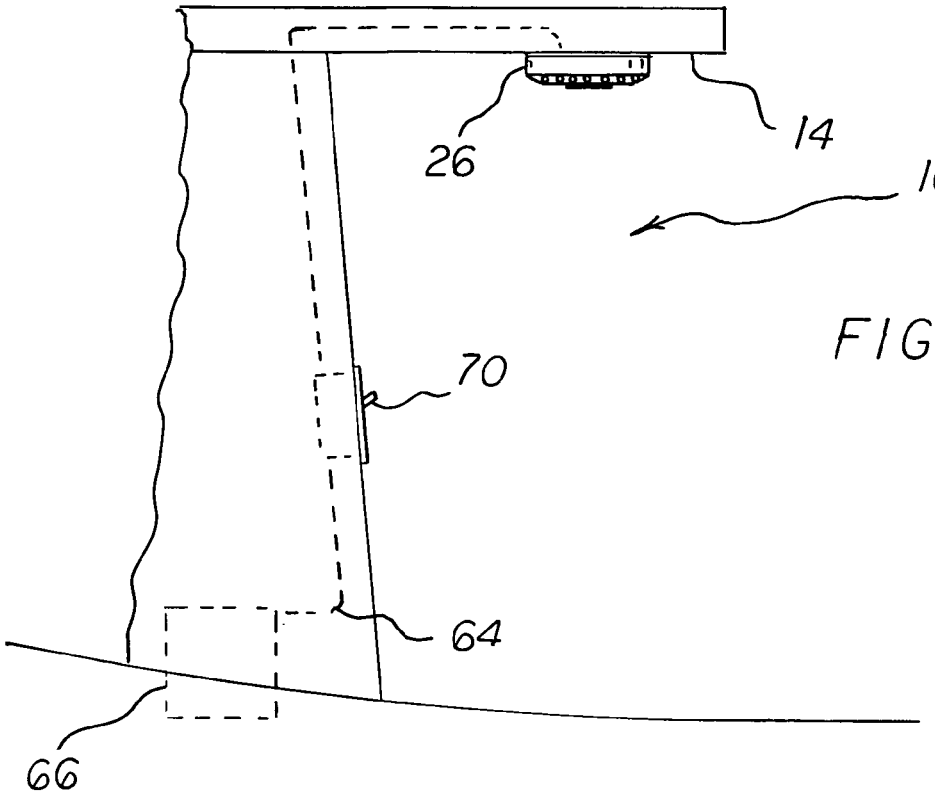
FIG. 5 is a side elevational view of the light system of the prior Figures while secured in a shower.

With reference now to the drawings, and in particular to FIG. 1 thereof, the preferred embodiment of the new and improved light emitting diode light system embodying the principles and concepts of the present invention and generally designated by the reference numeral 10 will be described.

The present invention, the light emitting diode light system 10 is comprised of a plurality of components. Such components in their broadest context include a housing, an annular printed circuit board and a plurality of light emitting diodes. Such components are individually configured and correlated with respect to each other so as to attain the desired objective.

The light emitting diode light system 10 for boat/trailer showers is for illuminating a showering area in a safe, convenient and economical manner. A light emitting diode may be referred to as an LED.

First provided is a showering area having a ceiling 14 with a hole and a water pipe 16 terminating beneath the hole. A shower head 18 has an upper section 20 coupled to the water pipe. The show head also has a radially enlarged lower section 22 with apertures for dispensing a flow of water into the showering area.

Next provided is a housing 26 having an upper component 28 in an inverted bowl-shaped configuration. The housing is formed of an upper circular plate 30 and a downwardly extending cylindrically shaped periphery 32. The upper circular plate is in contact with the ceiling. The upper circular plate has an upper central aperture 34 receiving the upper section of the shower head. The upper circular plate also has an annular undercut area 36 adjacent to the upper central aperture facing the ceiling for receiving the water pipe. The housing has a lower component 38 in a bowl-shaped configuration. The lower component is formed of a lower circular plate 40 and an upwardly extending cylindrical shaped periphery 42 receiving the periphery of the upper component. The lower circular plate has a lower central aperture 44 receiving the lower section of the shower head for supporting the housing. A chamber 46 is formed between the upper and lower components. A bolt 48 is threaded through the periphery of the lower component and contacting the periphery of the upper component for selectively coupling the upper and lower components.

An annular printed circuit board 52 is next provided. The printed circuit board is positioned within the housing. The printed circuit board is formed of four 90 degree segments 54. Each segment has ends with a spacer 56 through each end. The printed circuit board has a central opening receiving the lower component of the housing.

Next provided is a plurality of equally spaced light emitting diodes 60. The light emitting diodes are secured to the printed circuit board and extend downwardly therefrom. A plurality of equally spaced small apertures 62 are provided in the lower circular plate of the lower component. Each small aperture receives one of the light emitting diodes for providing a circle of light surrounding the shower head. Electrical wires 64 couple the printed circuit board to a source of electrical potential 66. The upper and lower components are fabricated of stainless steel.

A four position switch 70 is next provided. A first position functions to illuminate the light emitting diodes and feeds showering water through the water pipe and the housing. A second position functions for illuminating the light emitting diodes only. A third position functions for feeding water only and a fourth position for terminating both the illuminating and the feeding of showering water.

Figure 6:
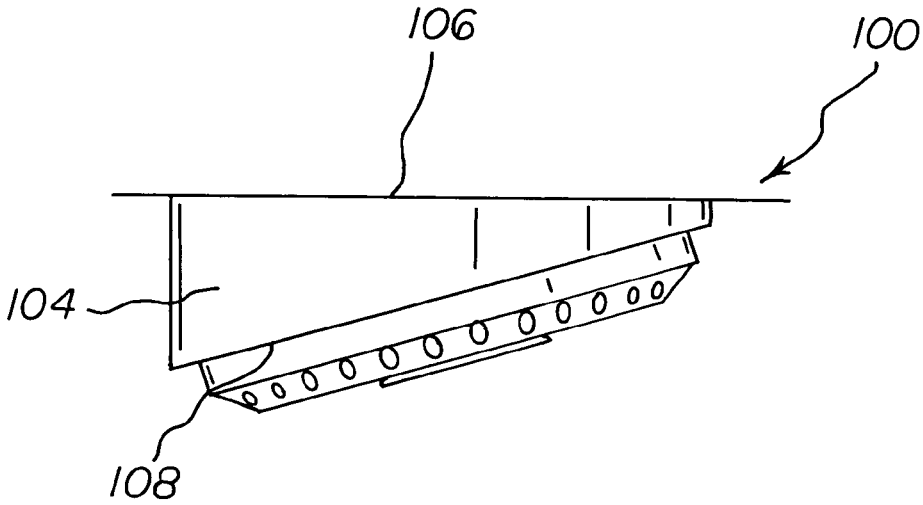
FIG. 6 is a side elevational view of a system constructed in accordance with an alternate embodiment of the invention.

Reference is now made to the alternate embodiment of the invention as illustrated in FIG. 6 wherein the system 100 further includes a spacing component 104. The spacing component has an upper end 106 positioned in a horizontal plane in contact with a ceiling and a lower end 108 positioned in a plane offset from the horizontal to receive and support the housing. The upper and lower ends are in planes at an angle with respect to each other whereby light will be projected and water will be dispensed at an angle with respect to the vertical.

Reference is now made to the broken line showings in FIG. 2 for an additional alternate embodiment of the invention, wherein the system 200 further includes supplemental light emitting diodes 204 coupled to the printed circuit board and equally spaced supplemental small apertures in the lower circular plate. Each equally spaced supplemental small aperture receives one of the supplemental light emitting diodes for providing increased illumination.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A light emitting diode light system comprising:

a housing having an upper component formed of an upper plate and a periphery, the housing having an aperture, the housing having a lower component formed of a lower plate and a periphery;

an annular printed circuit board positioned within the housing;

a plurality of light emitting diodes secured to the printed circuit board and extending downwardly therefrom, a plurality of equally spaced small light apertures in the lower plate of the lower component, each small light aperture receiving one of the light emitting diodes for providing light, the small light apertures being laterally spaced from each other; and a plurality of small water apertures in the lower component, the small light apertures being laterally spaced from each other, the small light apertures being laterally spaced from small water apertures.

2. A light emitting diode light system for boat/trailer showers for illuminating a showering area in a safe, convenient and economical manner, the system comprising, in combination:

a showering area having a ceiling with a hole and a water pipe terminating beneath the hole, a shower head having an upper section coupled to the water pipe and a radially enlarged lower section with apertures for dispensing a flow of water into the showering area;

a housing having an upper component in an inverted bowl-shaped configuration formed of an upper circular plate and a downwardly extending cylindrically shaped periphery, the upper circular plate being in contact with the ceiling, the upper circular plate having an upper central aperture receiving the upper section of the shower head, the upper circular plate having an annular undercut area adjacent to the upper central aperture facing the ceiling for receiving the water pipe, the housing having a lower component in a bowl-shaped configuration formed of a lower circular plate and an upwardly extending cylindrical shaped periphery receiving the periphery of the upper component, the lower circular plate having a lower central aperture 44 receiving the lower section of the shower head for supporting the housing, a chamber formed between the upper and lower components with a bolt threaded through the periphery of the lower component and contacting the periphery of the upper component for selectively coupling the upper and lower components;

an annular printed circuit board positioned within the housing, the printed circuit board being formed of four 90 degree segments, each segment having ends with a spacer through each end, the printed circuit board having a central opening receiving the lower component of the housing;

a plurality of equally spaced light emitting diodes secured to the printed circuit board and extending downwardly therefrom, a plurality of equally spaced small apertures in the lower circular plate of the lower component, each small aperture receiving one of the light emitting diodes for providing a circle of light surrounding the shower head, electrical wires coupling the printed circuit board to a source of electrical potential, the upper and lower components being fabricated of stainless steel; and a four position switch having a first position for illuminating the light emitting diodes and for feeding showering water through the water pipe and the housing, a second position for illuminating the light emitting diodes only, a third position for feeding water only and a fourth position for terminating both the illuminating and the feeding of showering water.

* * * * *